US005511713A

United States Patent [19]

Sakaguchi et al.

[11] Patent Number: 5,511,713

[45] Date of Patent: Apr. 30, 1996

[54] LATERAL STATIC GUIDE FOR A WEB LOOP OF VARIABLE WIDTH

[75] Inventors: Yasunobu Sakaguchi, Kanagawa; Koji Nakajimma; Junichi Kurumisawa, both of Saitama, all of Japan

[73] Assignees: Fuji Photo Film Co., Ltd., Kagawa; Fuji Photo Optical Co., Ltd., Saitama, Japan

[21] Appl. No.: 179,335

[22] Filed: Jan. 10, 1994

[30] Foreign Application Priority Data

Jan. 19, 1993 [JP] Japan ..... 5-006450

[51] Int. Cl.[6] ..... B65H 23/26

[52] U.S. Cl. ..... 226/199; 226/118; 242/563.1

[58] Field of Search ..... 226/18, 19, 113, 226/118, 196, 199, 92; 352/159; 242/563, 563.1, 566

[56] References Cited

U.S. PATENT DOCUMENTS

| | | | |
|---|---|---|---|
| 4,260,234 | 4/1981 | Burton | 226/118 X |
| 4,316,568 | 2/1982 | Grant et al. | 226/118 |
| 4,377,251 | 3/1983 | Kincheloe et al. | 226/118 X |
| 4,415,109 | 11/1983 | Pfister | 226/181 |
| 4,461,431 | 7/1984 | Wiley et al. | 242/563.1 |
| 4,489,872 | 12/1984 | Bolton et al. | 226/199 X |
| 4,641,939 | 2/1987 | Kitner | 226/91 X |
| 4,666,279 | 5/1987 | Fujita | 226/199 |
| 4,750,660 | 6/1988 | Kamimura | 226/199 |
| 4,772,907 | 9/1988 | Marson | 226/196 X |
| 4,846,387 | 7/1989 | Mano | 226/199 |
| 4,903,100 | 2/1990 | Kogane et al. | 226/118 |
| 4,967,222 | 10/1990 | Nitsch | 226/119 X |
| 5,187,531 | 2/1993 | Ozawa et al. | 242/563 |
| 5,195,690 | 11/1993 | Cross et al. | 226/118 X |
| 5,234,146 | 8/1993 | Meschi | 226/118 X |
| 5,317,358 | 5/1994 | Kawada | 226/199 X |
| 5,360,152 | 11/1994 | Matoushek | 226/19 X |

FOREIGN PATENT DOCUMENTS

| | | | |
|---|---|---|---|
| 1225018 | 6/1960 | France | 242/563.1 |
| 563456 | 5/1957 | Italy | 226/19 |

*Primary Examiner*—John P. Darling

*Attorney, Agent, or Firm*—Sughrue, Mion, Zinn, Macpeak & Seas; Richard C. Turner; Steven M. McGruskin

[57] ABSTRACT

A construction for guiding and holding an image recording material such as a photographic paper, including a pair of guide plates, a feed screw, and a control unit. The guide plates are disposed so as to oppose each other and are spaced apart from each other by a predetermined distance. The guide plates are supported so as to be movable in directions of approaching and moving apart from each other. The feed screw supports the pair of guide plates which are moved in the directions of approaching and moving apart from each other by rotating of the feed screw. The control unit causes the feed screw to rotate until the guide plates move to predetermined positions. Thus, the construction for guiding and holding the image recording material can guide and hold the image recording material such that the image recording material is curved in a loop shape and is slack. Consequently, image quality of the image recording material and smooth processing thereof can be ensured.

19 Claims, 5 Drawing Sheets

LATERAL STATIC GUIDE FOR A WEB LOOP OF VARIABLE WIDTH

BACKGROUND OF THE INVENTION

1. Field of the Invention

The present invention relates to a construction for guiding and holding an image recording material such as a photographic printing paper, such that the image recording material is curved in a loop shape and is slack, and in particular, to a guiding and holding construction suitable for a photosensitive material processing apparatus such as a printer processor.

2. Description of the Related Art

Printer processors which are photosensitive material processing apparatuses are installed in film printing stores which are called mini-labs. A printer processor is integrally constructed of a printer portion and a processor portion. The printer portion exposes and prints images recorded on a negative film, while the processor portion develops a photographic printing paper which has been printed. An elongated photographic printing paper which is wound in a roll shape is loaded in the printer processor, and the photographic printing paper is automatically conveyed to the printer portion and the processor portion and is processed. The printer portion of the printer processor enlarges images recorded on negative films by a selected, predetermined magnification and prints the resultant images on the photographic printing paper. The photographic printing paper on which the images have been printed are conveyed to the processor portion. The processor portion develops the images on the photographic printing paper as final photographic prints.

In other words, in such a photosensitive material processing apparatus, an elongated photographic printing paper is wound in a roll shape and contained in a light-shielding magazine. Whenever a printing process is performed, the photographic printing paper is pulled out a predetermined length from the magazine.

The photographic printing paper which has been pulled out the predetermined length is nipped and conveyed by a pair of conveying rollers to the printer portion which performs printing processing and exposing processing. Thereafter, the photographic printing paper is conveyed to the processor portion which performs developing processing, bleaching fixing processing, rinsing processing, and thereafter, drying processing.

In such a conventional photosensitive material processing apparatus, a photographic printing paper on which images of a negative film have been printed by an exposure portion of the printer portion is conveyed to the processor portion which performs developing processing. However, there is a time difference between the processing time of the exposure portion and that of the processor portion. To absorb the time difference, a reservoir portion is disposed between the exposure portion and the processor portion.

The reservoir portion temporarily stores the photographic printing paper which has been printed in such a way that the photographic printing paper is curved in a loop shape and is slack. Thus, the reservoir absorbs the time difference between the processing time in which the exposure portion performs printing processing and the processing time in which the processor portion performs developing processing, bleaching/fixing processing, and rinsing processing so that these portions can smoothly perform this series of processes.

However, since conventional reservoir portions stock the conveyed photographic printing paper in a state in which the photographic printing paper hangs down, if the photographic printing paper is long, it will curve and become slack in a plurality of directions rather than in one direction (for example, the photographic printing paper may curl in a spiral). As a result, there are occasions when the photographic printing paper is not properly conveyed to the processor portion. In particular, since the width of a photographic printing paper does not always accord with the size of images, when the width of the photographic printing paper is short, the photographic printing paper is likely to curve and become slack in a plurality of directions, which is a drawback that needs to be addressed.

SUMMARY OF THE INVENTION

The present invention has been made in view of the aforementioned, and an object thereof is to provide a construction for guiding and holding a thin, elongated image recording material, such as a photographic printing paper, in such a way that the image recording material curves in a loop shape and becomes slack so as to improve the image quality and ensure smooth processing thereof.

The present invention is a construction for guiding and holding an image recording material, comprising: guiding means for guiding and holding an image recording material, which has been conveyed, such that the image recording material is curved in a loop shape and is slack; moving means for supporting and moving the guiding means; and control means for controlling the moving means until the guiding means moves to a predetermined position.

In the construction according to the present invention, the image recording material is conveyed into the guiding means. The guiding means guides and holds the image recording material such that the image recording material curves in a loop shape and is slack.

Thus, the construction according to the present invention not only absorbs the time difference between the processing time of the processing portion upstream of the guiding means and the processing time of the processing portion downstream thereof, but also properly conveys the image recording material which is curved in the loop shape. Consequently, a series of processes can be smoothly performed.

When the image recording material is conveyed into the guiding means, the moving means is operated by the control means so that the guiding means is moved to predetermined positions.

Thus, the guiding means can guide the image recording material in accordance with the width thereof, thereby preventing the image recording material from becoming slack and curving in a plurality of directions.

As a result, the construction according to the present invention can guide and hold a thin, elongated image recording material such that the image recording material is slack and is curved in a loop shape, thereby improving the image quality thereof and ensuring smooth processing thereof.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENT

Figure 5:
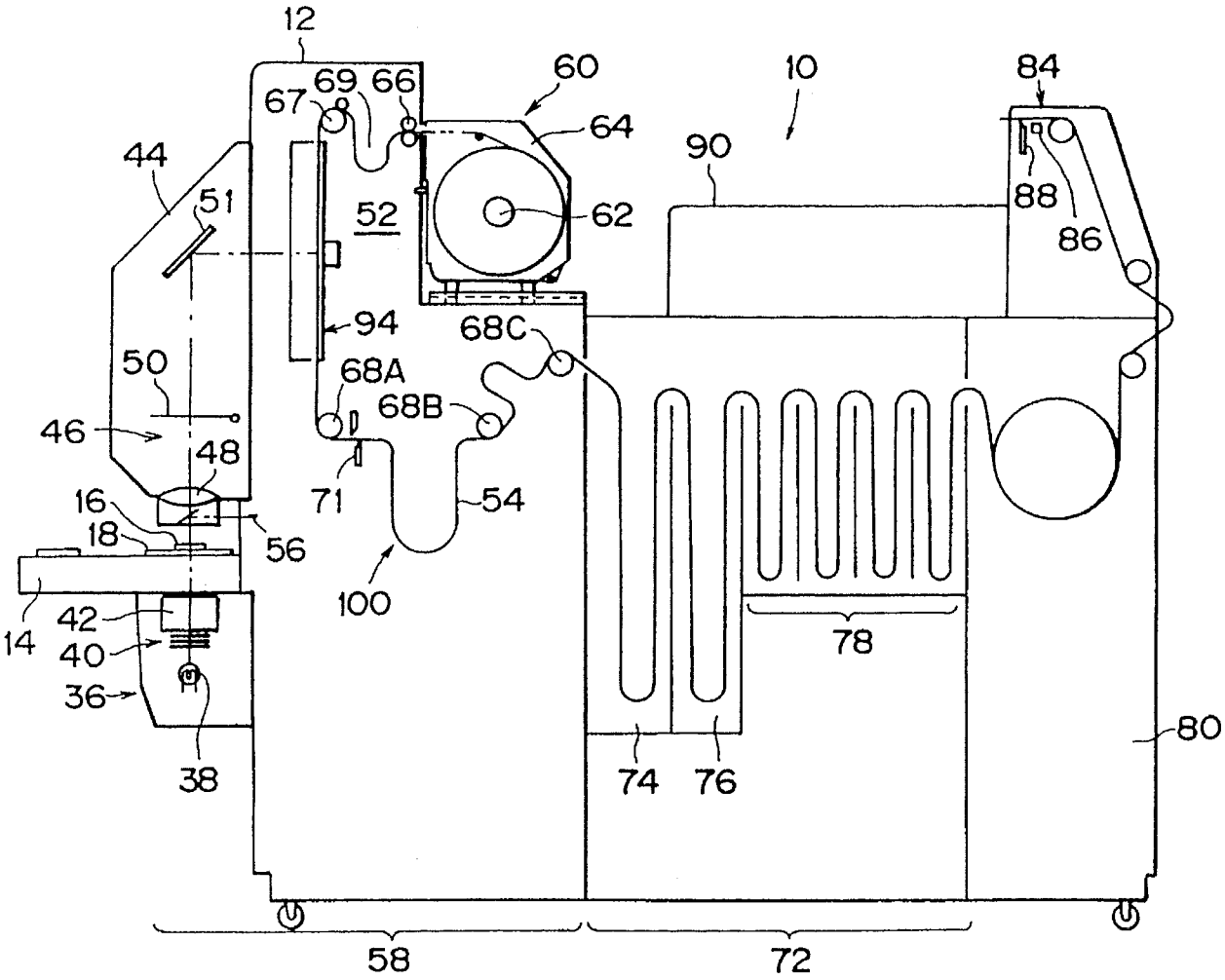
FIG. 5 is a schematic overall side view of the printer processor.

Referring to FIG. 5, a printer processor 10, to which a construction for guiding and holding an image recording material according to embodiments of the present invention is applied, will be described. First, the overall construction of the printer processor 10 will be described.

The printer processor 10 is covered by a casing 12. As shown in FIG. 5, the casing 12 has a work table 14 which protrudes leftward therefrom. A negative film carrier 18 is disposed on the upper surface of the work table 14. A negative film 16 is set in the negative film carrier 18. A light source portion 36 is disposed below the work table 14. The light source portion 36 is provided with a light source 38. Light irradiated from the light source 38 travels to the negative film 16, which is set in the negative film carrier 18, through a filter portion 40 and a diffusing cylinder 42. The filter portion 40 is constructed of three filters which are cyan, magenta, and yellow filters. Each of these filters can be selectively disposed on and withdrawn from the optical axis of the light.

An arm 44 is disposed above the work table 14. An optical system 46 is disposed at the arm 44. The optical system 46 comprises a lens 48, a shutter 50, and a reflecting mirror 51. The lens 48 and the shutter 50 are disposed on the optical axis of the light. The light which has been transmitted through the negative film 16 travels to the reflecting mirror 51 through the lens 48 and the shutter 50. The reflecting mirror 51 deflects the incident light approximately 90 degrees from the optical axis. Thus, an image of the negative film 16 is formed on a photographic printing paper 54 which is set in an exposing chamber 52.

The optical system 46 has a density measuring unit 56 (for example, a CCD) which measures the density of the negative film 16. The density measuring unit 56 is connected to a controller (not shown). An exposure correcting value is determined by data measured by the density measuring unit 56 and by data entered through the key input by the operator of the printer processor 10.

The light source portion 36, the optical system 46, and the exposing chamber 52 form a printer portion 58 which performs a printing processing.

A magazine accommodating portion 60 is disposed at an upper right corner of the exposing chamber 52. The magazine accommodating portion 60 accommodates a photographic printing paper magazine 64 which holds the elongated photographic printing paper 54 which is wound around a reel 62 in a roll shape. Several types of photographic printing paper magazines 64 which can hold photographic printing papers 54 of different widths are available. Thus, a photographic printing paper magazine 64 which accords with the width of a desired photographic printing paper can be used. A magazine sensor (not shown) which detects the type (namely, the width) of the set photographic printing paper magazine 64 is disposed at the magazine accommodating portion 60.

A pair of conveying rollers 66 are disposed in the vicinity of the magazine storing portion 60. The conveying rollers 66 nip and horizontally convey the photographic printing paper 54 to the exposing chamber 52. The photographic printing paper 54 is trained around a roller 67 which is disposed between the conveying rollers 66 and the arm 44. The roller 67 changes the conveying direction of the photographic printing paper 54 by 90 degrees so that the photographic printing paper 54 moves downwardly. A storage portion 69 is disposed between the conveying rollers 66 and the roller 67. The storage portion 69 guides and temporarily stores the photographic printing paper 54 in a substantially U-shape.

An exposing stage 94 is disposed at the downstream side of the roller 67 in the direction in which the photographic printing paper 54 is guided. A variable mask (not shown) is disposed at the exposing stage 94. The variable mask is opened or closed by a control unit (not shown). The control unit causes the length and width of a mask range of the variable mask to be changed according to the print size and the print type (such as presence/absence of white frame).

A roller 68A is disposed below an exposing position of the exposing chamber 52. The roller 68A changes the conveying direction of the photographic printing paper 54, on which images of the negative film 16 have been printed, by approximately 90 degrees. A cutter 71 is disposed at the downstream side of the roller 68A. The cutter 71 cuts the trailing end of the photographic printing paper 54 which has been printed. The photographic printing paper 54 which remains in the exposing chamber 52 can be rewound into the photographic printing paper magazine 64.

A roller 68B is disposed at a position which is horizontally opposite to the roller 68A. A reservoir portion 100 to which a construction for guiding and holding an image recording material according to the present invention is applied is disposed between the roller 68A and the roller 68B.

The reservoir portion 100 temporarily stores the photographic printing paper 54 so as to absorb the time difference between the processing time in which the exposing stage 94 of the printer portion 58 effects printing processing and the processing time in which the processor portion 72 effects developing processing, bleaching/fixing processing, and washing processing. In the present embodiment, the distance between the rollers 68A and 68B is 170 mm. The length of the photographic printing paper 54 which is temporarily stored in the reservoir portion 100 is 320 mm.

Figure 1:
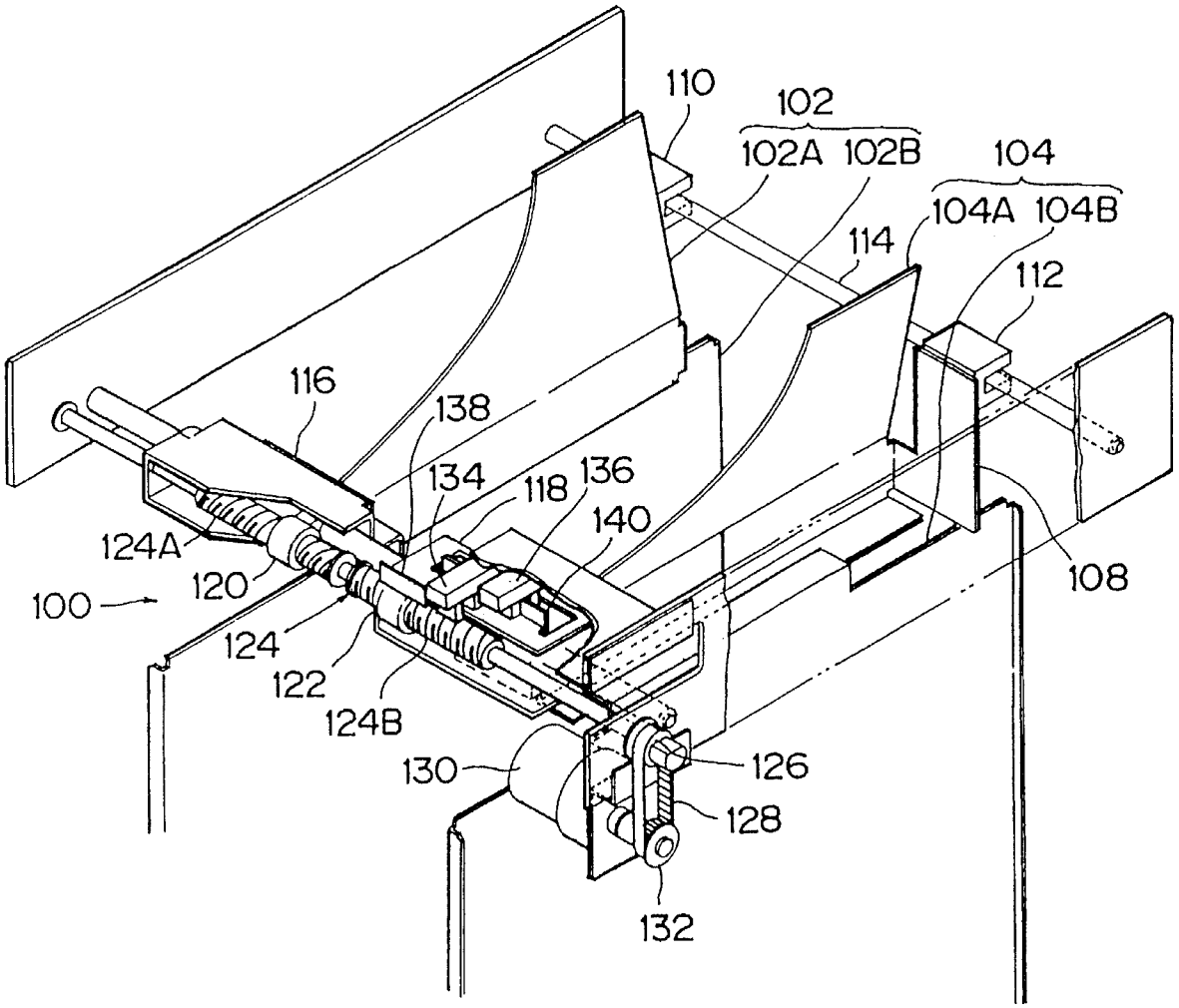
FIG. 1 is a perspective view showing a structure of a reservoir portion of a printer processor to which a construction for guiding and holding an image recording material according to an embodiment of the present invention is applied.
Figure 2:
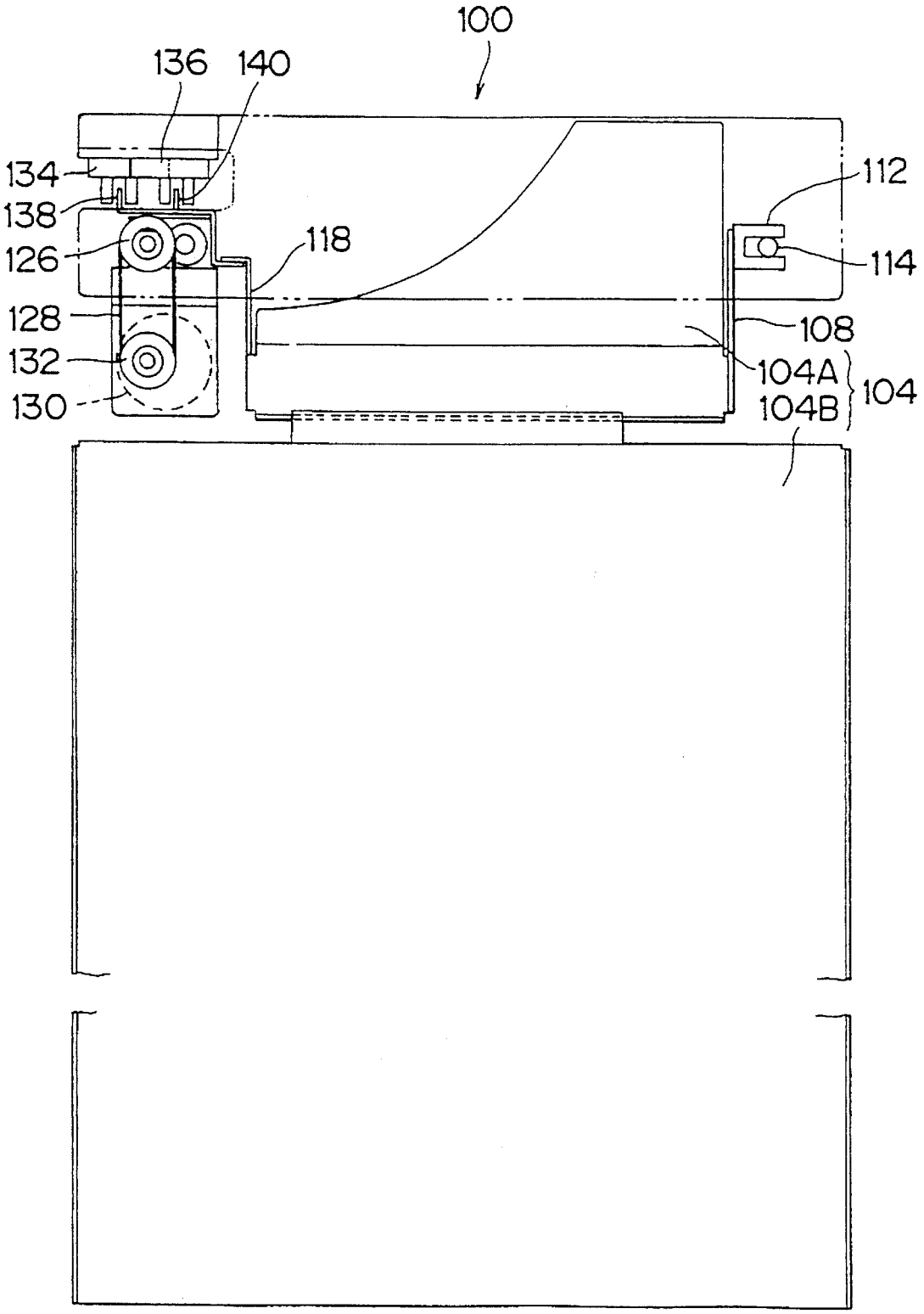
FIG. 2 is a front view of the reservoir portion of the printer processor.
Figure 3:
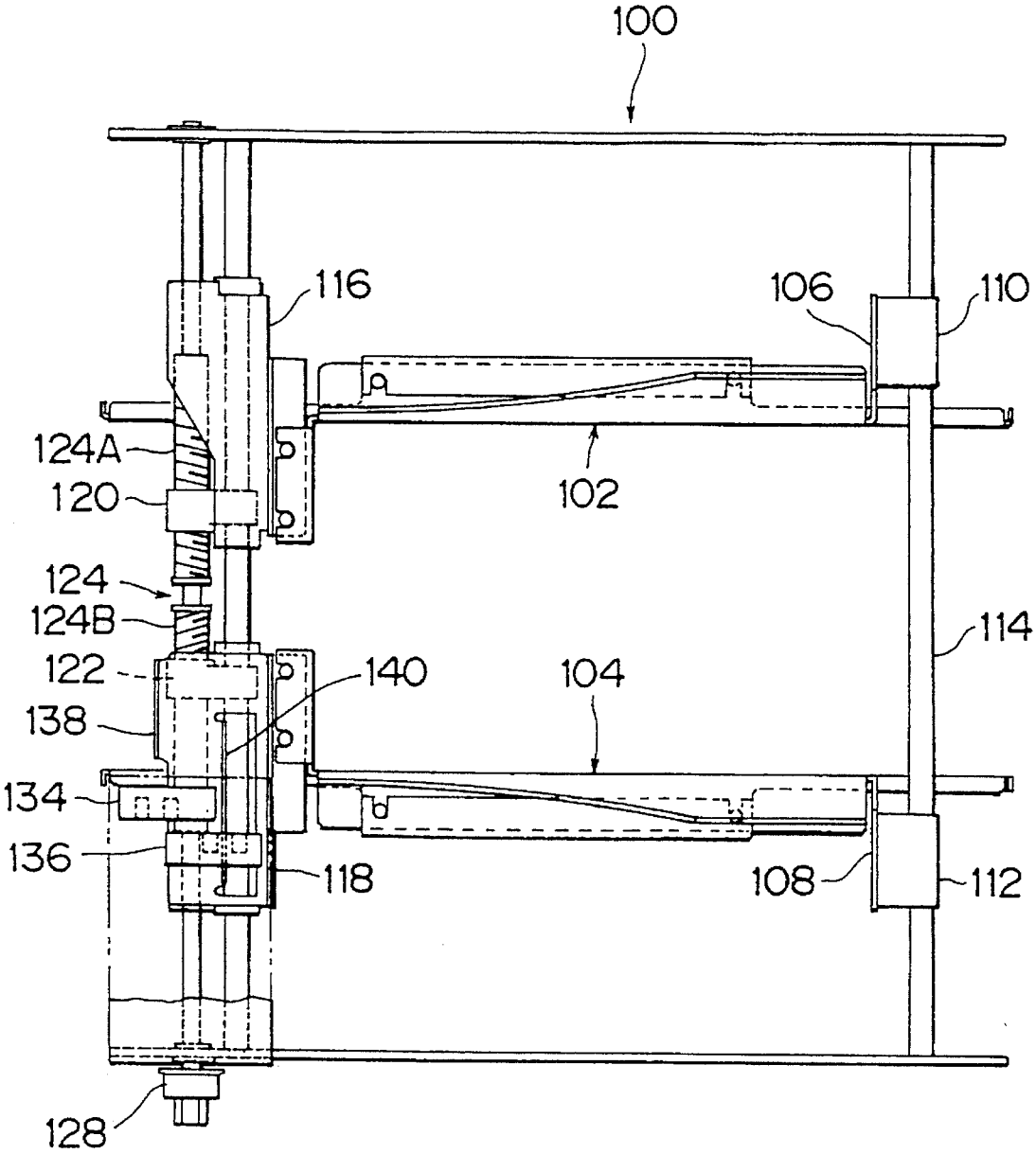
FIG. 3 is a plan view of the reservoir portion of the printer processor.
Figure 4:
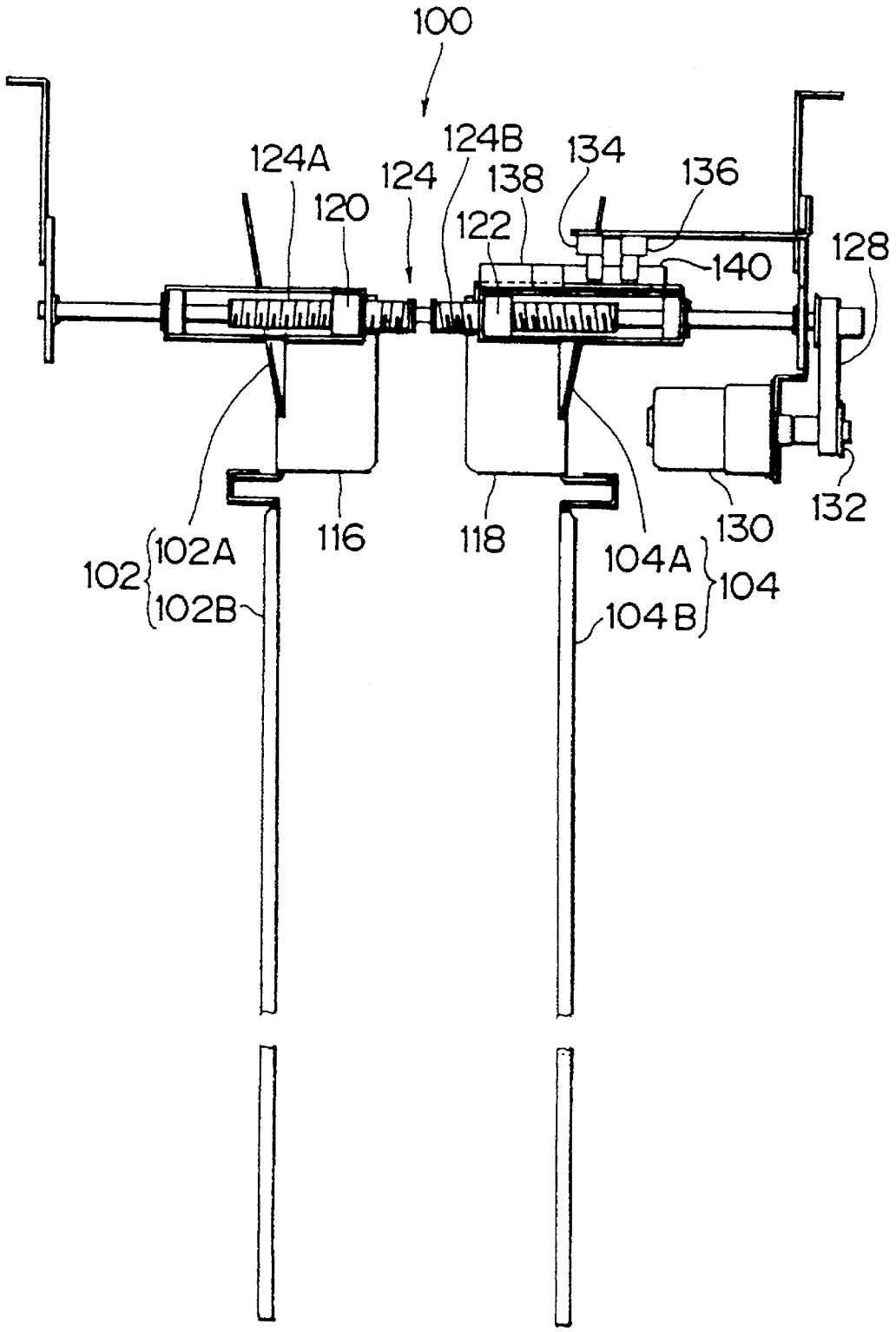
FIG. 4 is a side view of the reservoir portion of the printer processor.

FIG. 1 is a perspective view showing the structure of the reservoir portion 100. FIG. 2 is a front view illustrating the reservoir portion 100. FIG. 3 is a plan view showing the reservoir portion 100. FIG. 4 is a side view of the reservoir portion 100.

The reservoir portion 100 has a pair of guide plates 102 and 104. The guide plate 102 is formed by an upper guide portion 102A and a lower guide portion 102B. Likewise, the guide plate 104 is formed by an upper guide portion 104A and a lower guide portion 104B. The guide plates 102 and 104 are disposed so as to correspond to the transverse direction end portions of the photographic printing paper 54 which has been trained over and conveyed by the roller 68A. Respective portions of the upper guide portions 102A, 104A at the roller 68A side are cut out in circular arc shapes. Further, the upper guide portions 102A, 104A are formed so as to expand in an upward direction, i.e., so as to become larger toward upper portions thereof.

As illustrated in FIG. 3, an arm portion 106 extends from the end portion of the guide plate 102 at the roller 68B side. The arm portion 106 is fixed to a guide block 110. Likewise, an arm portion 108 extends the end portion of the guide plate 104 at the roller 68B side. The arm portion 108 is fixed to a guide block 112. The guide blocks 110 and 112 are slidably fitted to a guide bar 114 such that respective end portions of the guide plates 102 and 104 are supported.

An arm portion 116 extends from the end portion of the guide plate 102 at the roller 68A side. A screw block 120 is fixed to this end portion of the guide plate 102. Likewise, an arm portion 118 extends from the end portion of the guide plate 104 at the roller 68A side. A screw block 122 is fixed to this end portion of the guide plate 104. The screw blocks 120 and 122 are screwed with a feed screw 124 which serves as a feed screw means and which supports the end portions of the guide plates 102 and 104 at the roller 68A side. The feed screw 124 will be described hereinafter.

The feed screw 124 to which the screw blocks 120 and 122 are screwed has screw portions 124A and 124B. The screw portion 124A is screwed with the screw block 120. The screw portion 124B is screwed with the screw block 122. The direction of the screw of the screw portion 124A is the reverse of that of the screw portion 124B. Thus, when the feed screw 124 rotates in a forward direction, the screw blocks 120 and 122, namely, the guide plates 102 and 104, move in directions of moving apart from each other such that the distance therebetween increases. In contrast, when the feed screw 124 rotates in the reverse direction, the screw blocks 120 and 122, namely, the guide plates 102 and 104, move in directions of approaching each other such that the distance therebetween decreases.

A roller 126 is disposed at an end portion of the feed screw 124. A timing belt 128is trained around the roller 126.

A motor 130 is disposed below the feed screw 124. A roller 132 is disposed at the end of a rotating shaft of the motor 130. The timing belt 128 is trained around the roller 132. Thus, the feed screw 123 can be rotated in forward and reverse directions by the motor 130.

Sensors 134 and 136 which form a control means are disposed above the feed screw 124. The sensors 134 and 136 are disposed so as to correspond respectively to protrusions 138 and 140 fixed to the screw block 122. The sensors 134 and 136 detect the position of the screw block 122 which moves due to the rotation of the feed screw 124. The sensors 134 and 136 are connected to a control circuit (not shown) which receives detected signals from the sensors 134 and 136 and controls the rotation of the motor 130.

The supporting positions of the screw blocks 120 and 122, namely, the guide plates 102 and 104, are set by the distance (guide width) between the guide plates 102 and 104. The guide width is lager than a width of said image recording material. In a first embodiment of the present invention, the distance between the guide plates 102 and 104 is set to 92 mm, 155 mm, and 206 mm which are referred to as a first position, a second position, and a third position, respectively. The lengths of the protrusions 138 and 140 detected by the sensors 134 and 136 are set so as to correspond to the positions of the guide plates 102 and 104, respectively (which will be discussed in detail in the description of the operation of the present embodiment).

As illustrated in FIG. 5, a roller 68C is disposed above the roller 68B. The roller 68C changes the conveying direction of the photographic printing paper 54, which has been temporarily stored in the reservoir portion 100, by approximately 90 degrees, and conveys the photographic printing paper 54 to a color developing portion 74 of the processor portion 72 adjacent to the reservoir portion 100.

The color developing portion 74 effects a developing processing in such a way that the photographic printing paper 54 is soaked in a developing solution. The photographic printing paper 54, which has been developed, is conveyed from the color developing portion 74 to a bleaching/fixing portion 76. The bleaching/fixing portion 76 effects bleaching processing and fixing processing in such a way that the photographic printing paper 54 is soaked in bleaching/fixing solutions. The photographic printing paper 54, which has been subject to bleaching and fixing processing, is conveyed from the bleaching/fixing portion 76 to a rinsing portion 78 adjacent thereto. The rinsing portion 78 carries out rinsing processing in such a way that the photographic printing paper 54 is soaked in rinsing water.

A drying portion 80 is disposed adjacent to the processor portion 72 (rinsing portion 78). The drying portion 80 effects drying processing in such a way that the photographic printing paper 54, which has been rinsed, is trained over on rollers and dried by hot air. After the photographic printing paper 54 has been dried, it is nipped by a pair of rollers (not shown) and discharged from the drying portion 80.

A cutter portion 84 is disposed at the downstream side of the drying portion 80. The cutter portion 84 is formed by a cut mark sensor 86 and a cutter 88. The cut mark sensor 86 detects cut marks marked on the photographic printing paper 54. The cutter portion 84 cuts the photographic printing paper 54 per image frame into prints and discharges the prints to the exterior of the casing 12 of the printer processor 10.

A sorter portion 90 is disposed at the downstream side of the cutter portion 84. The sorter portion 90 sorts the cut prints of the photographic printing paper 54.

Next, operation of the present embodiment will be described.

When the printer processor 10 effects printing processing, the light source 38 is turned on and the negative film carrier 18 is driven so as to position tile negative film 16. The large area transmittance density (LATD) of the negative film 14 is measured by the density measuring unit 56. An exposure correction value is determined from the measured value and from data which is manually key input, and an exposure amount (exposure time) is calculated so as to obtain optimum printing conditions.

The photographic printing paper 54 is conveyed to the exposure chamber 52 positioned at the exposing stage 94. Thereafter, the shutter 50 is opened. Thus, light irradiated by the light source 88 is transmitted to the exposing chamber 52 through the filter portion 40 and the negative film 16. Consequently, printing of an image of the negative film 16 onto the photographic printing paper 54 positioned on the exposing stage 94 begins. The cyan, magenta, and yellow filters which are disposed on the optical axis of the light are moved in accordance with the exposure conditions which have been determined. After the predetermined exposure time has elapsed, the shutter 50 is closed. Thus, the printing processing for one image frame of the negative film 16 is completed. By repeating these steps, printed portions of the photographic printing paper 54 are successively conveyed to the reservoir portion 100. The printed portions are temporarily stored in the reservoir portion 100 and are then conveyed to the processor portion 72.

The photographic printing paper 54 is conveyed from the processor portion 72 to the color developing portion 74. The color developing portion 74 effects a developing processing in such a way that the photographic printing paper 54 is soaked in a developing solution. The photographic printing paper 54 is conveyed from the color developing portion 74 to the bleaching/fixing portion 76 where bleaching processing and fixing processing are carried out. The photographic printing paper 54 is conveyed from the bleaching/fixing portion 76 to the rinsing portion 78 where rinsing processing is effected. The rinsed photographic printing paper 54 is conveyed from the rinsing portion 78 to the drying portion 80 where drying processing is carried out.

The dried photographic printing paper 54 is conveyed from the drying portion 80 to the cutter portion 84. At the cutter portion 84, cut marks on the photographic printing paper 54 are detected, and the photographic printing paper 54 is cut per image into prints. The prints of the photographic printing paper 54, which have been cut, are conveyed to the sorter portion 90 where they are stored.

Before being conveyed to the processor portion 72, the printed photographic printing paper 54 is temporarily stored in the reservoir portion 100. In the reservoir portion 100, the photographic printing paper 54 is conveyed from the roller 68A to a gap between the upper guide portions 102A and 104A of the guide plates 102 and 104. The photographic printing paper 54 is guided by the upper guide portions 102A and 104A to a gap between the lower guide portions 102B and 104B. Thus, the photographic printing paper 54 being guided by the guide plates 102 and 104 is slack and is curved in a loop shape in one direction. In this state, both transverse direction end portions of the photographic printing paper 54 are interposed between and held by the guide plates 102 and 104.

Thus, the reservoir portion 100 can absorb the difference between the respective processing times of the processing portion at the upstream side of the guide plates 102 and 104 and of the processing portion at the downstream side thereof. In addition, in the reservoir portion 100, the photographic printing paper 54 bent in a loop shape can be conveyed properly. Consequently, the series of processes in the printer processor 10 can be performed properly.

When the photographic printing paper 54 is conveyed into the gap between the guide plates 102 and 104, the feed screw 124 is rotated by the driving of the motor 130. The guide plates 102 and 104 are moved to the supporting positions which are designated in accordance with the width of the photographic printing paper 54 between the guide plates 102 and 104.

Table 1 lists the positions of the guide plates 102 and 104, the detecting states of the sensors 134 and 136, and the state of rotation of the motor 130 of the first embodiment. Next, with reference to Table 1, the relations among the positions of the guide plates 102 and 104, the detecting states of the sensors 134 and 136, and the state of rotation of the motor 130 will be described.

TABLE 1

| Guide width | Sensor state | | Motor state (feed screw) until guide plates are moved to designated position | | |
|---|---|---|---|---|---|
| (mm) | 134 | 136 | First position | Second position | Third position |
| 92 or less | OFF | OFF | Forward rotation until sensor 136 ON | Forward rotation until sensor 134 ON | Forward rotation until sensor 136 OFF |
| 92–155 | OFF | ON | Reverse rotation until sensor 136 OFF | Reverse rotation until sensor 134 ON | Forward rotation until sensor 136 OFF |
| 155–206 | ON | ON | Reverse rotation until sensor 136 OFF | Reverse rotation until sensor 134 OFF | Forward rotation until sensor 136 OFF |
| 206 or more | ON | OFF | Reverse rotation until sensor 136 OFF | Reverse rotation until sensor 134 OFF | Reverse rotation until sensor 136 ON |

When the distance between the guide plates 102 and 104 is 92 mm or less, both of the sensors 134 and 136 do not detect the protrusions 138 and 140. Thus, at this point, the sensors 134 and 136 are in OFF states. When the width of the photographic printing paper 54 to be conveyed corresponds to the first position of the guide plates 102 and 104, the motor 130 is driven until the sensor 136 is turned on. The feed screw 124 rotates forward so that the guide plates 102 and 104 move in directions of moving apart from each other until the distance therebetween becomes 92 mm. When the width of the photographic printing paper 54 to be conveyed corresponds to the second position of the guide plates 102 and 104, the motor 130 is driven until the sensor 134 is turned on. The feed screw 124 rotates forward so that the guide plates 102 and 104 move further apart from each other until the distance therebetween becomes 155 mm. When the width of the photographic printing paper 54 to be conveyed corresponds to the third position of the guide plates 102 and 104, the motor 130 is driven until the sensor 136 which had been turned on is turned off. The feed screw 124 rotates forward so that the guide plates 102 and 104 move further apart from each other until the distance therebetween becomes 206 mm.

When the distance between the guide plates 102 and 104 is in the range of 92 mm to 155 mm, only the sensor 136 is in an ON state. When the width of the photographic printing paper 54 to be conveyed corresponds to the first position of the guide plates 102 and 104, the motor 130 is driven until the sensor 136 is turned off. Thus, the feed screw 124 rotates reversely so that the guide plates 102 and 104 approach each other until the distance therebetween becomes 92 mm. When the width of the photographic printing paper 54 to be conveyed correspond to the second position of the guide plates 102 and 104, the motor is driven until the sensor 134 is turned on. The feed screw 124 rotates forward so that the guide plates 102 and 104 move apart from each other until the distance therebetween becomes 155 mm. When the width of the photographic printing paper 54 to be conveyed corresponds to the third position of the guide plates 102 and 104, the motor 130 is driven until the sensor 136 which had been turned on is turned off. The feed screw 124 rotates forward so that the guide plates 102 and 104 move further apart from each other until the distance therebetween becomes 206 mm.

When the distance between the guide plates 102 and 104 is in the range of 155 mm to 206 mm, both of the sensors 134 and 136 are in ON states. When the width of the photographic printing paper 54 to be conveyed corresponds with the first position of the guide plates 102 and 104, the motor 130 is driven until both of the sensors 134 and 136 are turned off. The feed screw 124 rotates reversely so that the guide plates 102 and 104 approach each other until the distance therebetween becomes 92 mm. When the width of the photographic printing paper 54 to be conveyed corresponds to the second position of the guide plates 102 and 104, the motor 130 is driven until the sensor 134 is turned off. The feed screw 124 rotates reversely so that the guide plates 102 and 104 approach each other until the distance therebetween becomes 155 mm. When the width of the photographic printing paper 54 to be conveyed corresponds to the third position of the guide plates 102 and 104, the motor 130 is driven until the sensor 136 is turned off. Thus, the feed screw 124 rotates forward so that the guide plates 102 and 104 move apart from each other until the distance therebetween becomes 206 mm.

When the distance between the guide plates 102 and 104 is 206 mm or more, only the sensor 134 is in an ON state. When the width of the photographic printing paper 54 to be conveyed corresponds to the first position of the guide plates 102 and 104, the motor 130 is driven until the sensor 136 which had been turned on is turned off, The feed screw 124 rotates reversely so that the guide plates 102 and 104 approach each other until the distance therebetween becomes 92 mm. When the width of the photographic printing paper 54 to be conveyed corresponds to the second position of the guide plates 102 and 104, the motor 130 is driven until the sensor 134 is turned off. The feed screw 124 rotates reversely so that the guide plates 102 and 104 approach each other until the distance therebetween becomes 155 mm. When the width of the photographic printing paper 54 to be conveyed corresponds to the third position of the guide plates 102 and 104, the motor 130 is driven until the sensor 136 is turned on. Thus, the feed screw 124 rotates reversely so that the guide plates 102 and 104 approach each other until the distance therebetween becomes 206 mm.

Table 2 lists the positions of the guide plates 102 and 104, the detecting states of the sensors 134 and 136, and the state of rotation of the motor 130 of a second embodiment of the present invention. Next, with reference to Table 2, the relations among the positions of the guide plates 102 and 104, the detecting states of the sensors 134 and 136, and the state of rotation of the motor 130 will be described.

In the second embodiment, the distance between the guide plates 102 and 104 is set to 96 mm, 159 mm, and 217 mm which are referred to as a first position, a second position, and a third position, respectively.

When the distance between the guide plates 102 and 104 is 96 mm or less, both of the sensors 134 and 136 do not detect the protrusions 138 and 140. Thus, at this point, the sensors 134 and 136are in OFF states. When the width of the photographic printing paper 54 to be conveyed corresponds to the first position of the guide plates 102 and 104, the motor 130 is driven until the sensor 136 is turned on. The feed screw 124 rotates forward so that the guide plates 102 and 104 move in directions of moving apart from each other until the distance therebetween becomes 96 mm. When the width of the photographic printing paper 54 to be conveyed corresponds to the second position of the guide plates 102 and 104, the motor 130 is driven until the sensor 134 is turned on. The feed screw 124 rotates forward so that the guide plates 102 and 104 move further apart from each other until the distance therebetween becomes 159 mm. When the width of the photographic printing paper 54 to be conveyed corresponds to the third position of the guide plates 102 and 104, the motor 130 is driven until the sensor 136 which had been turned on is turned off. The feed screw 124 rotates forward so that the guide plates 102 and 104 move further apart from each other until the distance therebetween becomes 217 mm.

When the distance between the guide plates 102 and 104 is in the range of 96 mm to 159 mm, only the sensor 136 is in an ON state. When the width of the photographic printing paper 54 to be conveyed corresponds to the first position of the guide plates 102 and 104, the motor 130 is driven until the sensor 136 is turned off. Thus, the feed screw 124 rotates reversely so that the guide plates 102 and 104 approach each other until the distance therebetween becomes 96 mm. When the width of the photographic printing paper 54 to be conveyed correspond to the second position of the guide plates 102 and 104, the motor is driven until the sensor 134 is turned on. The feed screw 124 rotates forward so that the guide plates 102 and 104 move apart from each other until the distance therebetween becomes 159 mm. When the width of the photographic printing paper 54 to be conveyed corresponds to the third position of the guide plates 102 and 104, the motor 130 is driven until the sensor 136 which had been turned on is turned off. The feed screw 124 rotates forward so that the guide plates 102 and 104 move further apart from each other until the distance therebetween becomes 217 mm.

When the distance between the guide plates 102 and 104 is in the range of 159 mm to 217 mm, both of the sensors 134 and 136 are in ON states. When the width of the photographic printing paper 54 to be conveyed corresponds to with the first position of the guide plates 102 and 104, the motor 130 is driven until both of the sensors 134 and 136 are turned off. The feed screw 124 rotates reversely so that the

TABLE 2

| Guide width | Sensor state | | Motor state (feed screw) until guide plates are moved to designated position | | |
|---|---|---|---|---|---|
| (mm) | 134 | 136 | First position | Second position | Third position |
| 96 or less | OFF | OFF | Forward rotation until sensor 136 ON | Forward rotation until sensor 134 ON | Forward rotation until sensor 136 OFF |
| 96–159 | OFF | ON | Reverse rotation until sensor 136 OFF | Forward rotation until sensor 134 ON | Forward rotation until sensor 136 OFF |
| 159–217 | ON | ON | Reverse rotation until sensor 136 OFF | Reverse rotation until sensor 134 OFF | Forward rotation until sensor 136 OFF |
| 217 or more | ON | OFF | Reverse rotation until sensor 136 OFF | Reverse rotation until sensor 134 OFF | Reverse rotation until sensor 136 ON |

guide plates 102 and 104 approach each other until the distance therebetween becomes 96 mm. When the width of the photographic printing paper 54 to be conveyed corresponds to the second position of the guide plates 102 and 104, the motor 130 is driven until the sensor 134 is turned off. The feed screw 124 rotates reversely so that the guide plates 102 and 104 approach each other until the distance therebetween becomes 159 mm. When the width of the photographic printing paper 54 to be conveyed corresponds to the third position of the guide plates 102 and 104, the motor 130 is driven until the sensor 136 is turned off. Thus, the feed screw 124 rotates forward so that the guide plates 102 and 104 move apart from each other until the distance therebetween becomes 217 mm.

When the distance between the guide plates 102 and 104 is 217 mm or more, only the sensor 134 is in an ON state. When the width of the photographic printing paper 54 to be conveyed corresponds to the first position or the guide plates 102 and 104, the motor 130 is driven until the sensor 136 which had been turned on is turned off. The feed screw 124 rotates reversely so that the guide plates 102 and 104 approach each other until the distance therebetween becomes 96 mm. When the width of the photographic printing paper 54 to be conveyed corresponds to the second position or the guide plates 102 and 104, the motor 130 is driven until the sensor 134 is turned off. The feed screw 124 rotates reversely so that the guide plates 102 and 104 approach each other until the distance therebetween becomes 159 mm. When the width of the photographic printing paper 54 to be conveyed corresponds to the third position of the guide plates 102 and 104, the motor 130 is driven until the sensor 136 is turned on. Thus, the feed screw 124 rotates reversely so that the guide plates 102 and 104 approach each other until the distance therebetween becomes 217 mm.

What is claimed is:

1. A construction for guiding and holding an image recording material, comprising:

guiding means for guiding and holding an image recording material such that said image recording material is curved in a loop shape and is slack;

moving means for moving said guiding means;

sensing means for sensing a position of said moving means and for outputting signals indicating said position; and control means for receiving the signals output by said sensing means and for controlling said moving means based on the signals.

2. A construction for guiding and holding an image recording material according to claim 1, wherein said guiding means comprises a pair of guide plates, said guide plates being disposed so as to oppose each other and so as to be spaced apart from each other by a predetermined distance, said guide plates being supported such that said guide plates are movable in directions approaching and moving away from each other.

3. A construction for guiding and holding an image recording material according to claim 1, further comprising:

supporting means for movably supporting said guiding means.

4. A construction for guiding and holding an image recording material according to claim 1, wherein said control means controls said moving means to move said guiding means to a predetermined position in accordance with a width of the image recording material.

5. A construction for guiding and holding an image recording material according to claim 1, further comprising:

driving means, connected to said control means, for operating said moving means while being controlled by said control means.

6. A construction for guiding and holding an image recording material according to claim 5, wherein said driving means comprises:

a motor disposed in a vicinity of said moving means; and a timing belt connected between said moving means and said motor so as to transmit a driving force of said motor to said moving means.

7. A construction for guiding and holding an image recording material according to claim 6, wherein said control means controls forward and reverse rotation of said motor in accordance with combinations of detected signals output by said sensing means in order to move said guiding means to an optimum position corresponding to a width of the image recording material.

8. A construction for guiding and holding an image recording material such that the image recording material is curved in a loop shape and is slack, comprising:

a pair of guide plates disposed so as to oppose each other and so as to correspond to both transverse direction ends of said image recording material, said pair of guide plates being supported so as to be movable in directions approaching and moving away from each other;

moving means for moving said guide plates toward and away from each other;

sensing means for sensing positions of said moving means and for outputting a signal when said moving means moves said guide plates to a predetermined position corresponding to a width of the image recording material; and control means for receiving the signal output by said sensing means and for controlling said moving means to move said guide plates to the predetermined position.

9. A construction for guiding and holding an image recording material according to claim 8, wherein each of said guide plates is formed by an upper guide portion and a lower guide portion, and a portion of said upper guide portion at an upstream side in a conveying direction of said image recording material is cut out in a circular arc shape and said upper guide portion is formed so as to expand in an upward direction, and said image recording material is received by said upper guide portions so as to be conveyed into a gap between said upper guide portions and is interposed between and held by said lower guide portions while being guided by said lower guide portions.

10. A construction for guiding and holding an image recording material according to claim 8, wherein said moving means comprises a feed screw having a pair of screw portions which are threaded in opposite directions, and a pair of screw blocks respectively fixed to said pair of guide plates and respectively screwed with said pair of screw portions, and when said feed screw is rotated in a forward direction, said pair of screw blocks are moved in directions of moving apart from each other such that said pair of guide plates are moved in directions of moving apart form each other and a distance between said pair of guide plates is increased, and when said feed screw is rotated in a reverse direction, said pair of screw blocks are moved in directions of approaching each other such that said pair of guide plates are moved in directions of approaching each other and the distance between said pair of guide plates is decreased.

11. A construction for guiding and holding an image recording material according to claim 10, wherein said sensing means senses positions of at least one of said screw blocks.

12. A construction for guiding and holding an image recording material according to claim 10, wherein said sensing means comprises a pair of sensors disposed at at least one of said pair of screw blocks for detecting positions of said at least one of said pair of screw blocks.

13. A construction for guiding and holding an image recording material according to claim 10, wherein said sensing means is disposed at positions corresponding to protrusions connected and fixed to at least one of said pair of screw blocks, said control means controlling rotation of said feed screw to move said guide plates to positions at which the distance between said guide plates is a predetermined value.

14. A construction for guiding and holding an image recording material such that said image recording material is curved in a loop shape and is slack, comprising:

a pair of guide plates disposed so as to oppose each other and so as to correspond to transverse direction end portions of said image recording material;

a feed screw having a pair of screw portions which are threaded in opposite directions;

a pair of screw blocks respectively fixed to said pair of guide plates and respectively screwed with said pair of screw portions;

a pair of sensors disposed at at least one of said pair of screw blocks for detecting positions of said at least one of said pair of screw blocks; and a motor for rotating said feed screw until said guide plates are moved to supporting positions which are set so as to correspond to a width of the image recording material.

15. A construction for guiding and holding an image recording material according to claim 14, further comprising protrusions fixed and connected to at least one of said pair of screw blocks, said sensors detecting positions of said protrusions when said screw blocks are moved due to rotation of said feed screw.

16. A construction for guiding and holding an image recording material according to claim 14, wherein each of said guide plates comprises an upper guide portion and a lower guide portion, a portion of said upper guide portions at an upstream side in a conveying direction of said image recording material being cut out in a circular arc shape, and said upper guide portions being formed so as to diverge in an upward direction.

17. A construction for guiding and holding an image recording material according to claim 14, further comprising:

a guide bar disposed so as to extend parallel to said feed screw; and a guide block fitted to said guide bar and connected to said guide plates, wherein said feed screw and said guide block support said guide plates.

18. A construction for guiding and holding an image recording material according to claim 14, wherein said sensors detect whether a distance between said guide plates is a predetermined value, and wherein forward and reverse rotation of said motor is controlled in accordance with combinations of detected signals output by said sensors, said guide plates being moved by said motor to optimum positions in accordance with the width of said image recording material.

19. A construction for guiding and holding an image recording material according to claim 18, wherein said pair of guide plates is set at a first position for a small width material of said image recording material, said pair of guide plates is set at a second position for an intermediate width material of said image recording material, and said pair of guide plates is set at a third position for a large width material of said image recording material, and lengths of said pair of protrusions detected by said pair of sensors are set in accordance with said first position, said second position, and said third position.

* * * * *